US009583078B1

(12) United States Patent
Nagahara

(10) Patent No.: US 9,583,078 B1
(45) Date of Patent: Feb. 28, 2017

(54) PAD ASSEMBLY

(71) Applicant: Kanichi Nagahara, Chelmsford, MA (US)

(72) Inventor: Kanichi Nagahara, Chelmsford, MA (US)

( * ) Notice: Subject to any disclaimer, the term of this patent is extended or adjusted under 35 U.S.C. 154(b) by 0 days.

(21) Appl. No.: 15/074,634

(22) Filed: Mar. 18, 2016

(51) Int. Cl.
*G10D 9/04* (2006.01)

(52) U.S. Cl.
CPC ..... *G10D 9/043* (2013.01)

(58) Field of Classification Search
CPC ..... G10D 9/043
See application file for complete search history.

(56) References Cited

U.S. PATENT DOCUMENTS 1,702,962 A * 2/1929 Buescher ..... G10D 9/043 84/380 R
2,759,386 A * 8/1956 Pascucci ..... G10D 9/043 84/380 R
3,421,399 A * 1/1969 Bryant ..... G10D 9/043 84/380 R
3,691,892 A 9/1972 Matsuura et al.
3,767,506 A * 10/1973 Kawakami ..... G10D 9/043 156/293
4,158,979 A * 6/1979 Suzuki ..... G10D 9/043 84/385 P
4,704,939 A * 11/1987 Straubinger ..... G10D 9/043 84/385 P
4,708,047 A * 11/1987 Kanazawa ..... G10D 9/043 84/385 P
4,729,275 A * 3/1988 Elbaz ..... G10D 9/043 84/385 P
4,967,632 A * 11/1990 Etheredge, III ..... G10D 9/043 84/385 P
5,900,562 A * 5/1999 Smeding ..... G10D 9/043 84/380 R
6,028,256 A * 2/2000 Straubinger ..... G10D 9/043 84/380 R
6,284,958 B1 * 9/2001 Aoki ..... G10D 9/043 84/385 P
6,664,455 B2 * 12/2003 Aoki ..... G10D 9/043 84/385 A
6,972,361 B2 * 12/2005 Shibamiya ..... G10D 9/043 84/385 P
7,459,621 B2 * 12/2008 Straubinger ..... G10D 9/043 84/385 P
7,468,479 B2 * 12/2008 Kraus ..... G10D 9/043 84/385 P
2003/0070531 A1 * 4/2003 Aoki ..... G10D 9/043 84/385 P
2014/0360336 A1 * 12/2014 Uesawa ..... G10D 9/043 84/330

* cited by examiner

*Primary Examiner* — Robert W Horn
(74) *Attorney, Agent, or Firm* — Lambert & Associates; Gary E. Lambert; David J. Connaughton, Jr.

(57) ABSTRACT

A pad assembly for a flute or other woodwind instrument is provided. The pad assembly may have an upwardly protruding chimney on either a pad base or integral to the pad itself. The pad assembly may be held in place by a washer and screw that is screwed into a spud of a cup, which moves to open and close a tone hole. The upwardly protruding chimney causes compression between the pad and washer, and prevents the washer from directly contacting the spud by creating a spacing between washer and spud. Such a configuration allows the pad assembly to remain in a correct orientation if the cup and a tone hole are misaligned.

20 Claims, 5 Drawing Sheets

PAD ASSEMBLY

BACKGROUND OF THE INVENTION

Field of the Invention

The present invention relates generally to pad assemblies for woodwind instruments. More particularly the present invention relates to a pad assembly that allows a tone hole-sealing pad to be optimally oriented on the tone hole even if the pad cup or cup retaining assembly is deformed or imperfectly installed.

Description of Related Art

The size of the tone holes on the modern flute necessitate the use of a cup and pad arrangement, the tone holes being too large and numerous to be closed with only 10 comparatively small human fingers. On a modern professional-level flute, there are three types of pad and cup arrangements, type 1 being a "spud and washer" design, whereby the pad is secured into the cup by means of a screw, which, when inserted into its threaded receiver (or "spud"), then tightens a washer on top of the pad, which holds it in its respective cup. The second type of arrangement may be described "bushing and chimney" design, whereby the pad is held in its cup by means of a flanged bushing pressed into the central hole of a cup. In the third type of arrangement, the pad is simply held in place with a backing of glue or resin, and is not part of the current invention.

The pad's orientation to the tone hole can be affected by several factors, including finger pressure, humidity, temperature, etc. The factors that the current invention addresses are cups that are out of alignment with the tone hole due to bending or warpage and/or improperly installed spuds. flute makers do their best to minimize these factors, but it does happen, and indeed flutes can be damaged once out of the makers control, necessitating repair outside the makers shop by repairmen who may not be as skilled as the original maker.

A warped cup is detrimental to the pad's orientation to the tone hole in that the cup is designed to hold the pad at a certain angle and plane. If the cup becomes misshapen during manufacture or is later damaged, the pad will conform to the shape of its cup and be brought out of optimal alignment. Spuds are typically soldered into place inside the cup, but if too little solder is used, the spud may not properly seat against the cup. Conversely, if too much solder is used, the spud may float out of its optimum orientation.

Previous pad and cup arrangements typically feature the screw/washer being tightened down until it contacts the spud (in the case of type 1), or the bushing being pressed down until sufficient resistance is felt such that further pressure would deform the cup (in the case of type 2). In the first case, if the spud is not installed correctly, the washer will conform to the incorrect spud, and exert pressure on the pad unevenly, thus deforming it and preventing it from performing its function properly. In the second case, if the flanged bushing is not installed using even, steady pressure, it can be out of alignment with the pad, and result in a similar situation to the first case.

Therefore, what is needed is a device that may provide a complete and effective seal even if the cup and tone hole are not in alignment.

SUMMARY OF THE INVENTION

The subject matter of this application may involve, in some cases, interrelated products, alternative solutions to a particular problem, and/or a plurality of different uses of a single system or article.

In one aspect, a pad assembly for a woodwind instrument is provided. The pad assembly has a base configured to be attached to a cup of an instrument key assembly. The pad assembly may also comprise a pad retainer positioned on top of the base, as well as a pad positioned above the pad retainer. Each of these components has a rounded top-view cross section with an approximately circular central opening through their heights. A chimney is formed by the base. This chimney is formed as an upward protrusion that extends about an inner circumference of the base adjacent to the circular central opening towards the pad.

In another aspect a pad assembly for a woodwind instrument is provided. The pad assembly has a base configured to be attached to a cup of an instrument key assembly. The pad assembly may also comprise a pad retainer positioned on top of the base, as well as a pad positioned above the pad retainer. Each of these components has a rounded top-view cross section with an approximately circular central opening through their heights. A chimney is formed by the pad retainer. This chimney is formed as an upward protrusion that extends about an inner circumference of the pad retainer adjacent to the circular central opening towards the pad. A ring insert having a ring shape is positioned on a top of the chimney. In one aspect, this ring insert has a thickness different from a thickness of the pad, while still providing an approximately continuous face across a top of the pad and a top of the ring insert. In another aspect, this ring insert has a hardness different from a hardness of the pad, while still providing an approximately continuous face across a top of the pad and the ring insert.

In many embodiments, the chimney and ring insert (depending on embodiment) ensure that a washer that connects the assembly to the cup of the instrument tone hole closure assembly is spaced apart from a protruding spud of the cup, preventing contact between the washer and spud.

DETAILED DESCRIPTION

Figure 1:
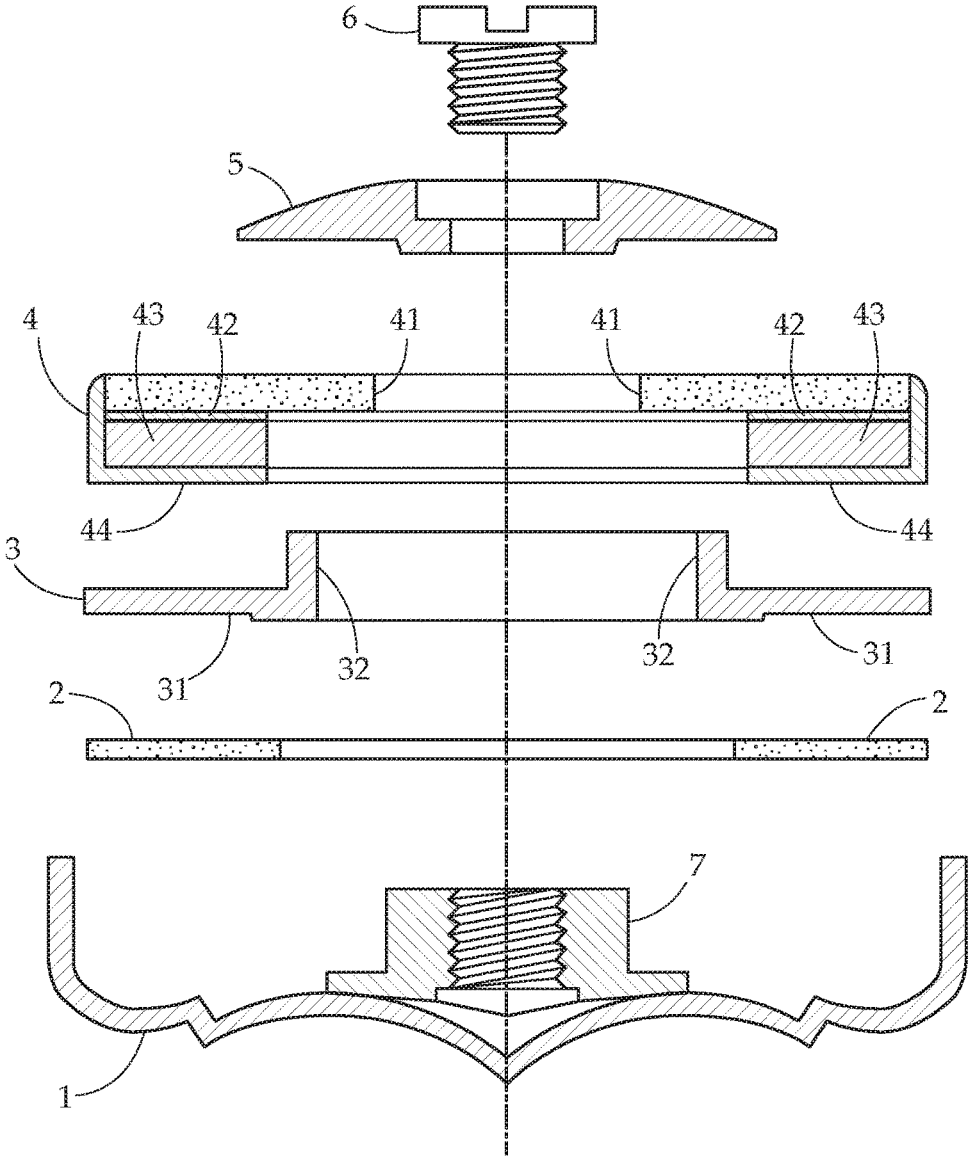
FIG. 1 provides a side cross sectional exploded view of an embodiment of the present invention.

The detailed description set forth below in connection with the appended drawings is intended as a description of presently preferred embodiments of the invention and does not represent the only forms in which the present invention may be constructed and/or utilized. The description sets forth the functions and the sequence of steps for constructing and operating the invention in connection with the illustrated embodiments.

This invention relates to the field of woodwind musical instruments, such as a flute. Generally, the present invention concerns a sealing pad assembly for closing a wind instrument's tone hole, as well as a device for containing and securing the pad assembly. The pad may be formed as a soft material to provide an air tight seal of the instrument's tone hole. The assembly comprises additional supporting components that minimize deformation of the pad surface and deter tearing which can occur during performance of the instrument. Importantly, the present invention allows the pad to be optimally oriented on the tone hole to ensure sealing of the tone hole even in the event of a warped pad cup, imperfectly installed cup retaining assembly, or other deformations of the instrument.

In an embodiment of operation, different musical pitches are realized on woodwind instruments such as the modern flute by means of closing various tone holes along the length of the flute while playing. It is critical to the proper sounding of the instrument that the tone holes are completely and firmly sealed off around their circumference, and that this sealing occur simultaneously around the tone hole's entire circumference. That is, one side of the tone hole should not be closed before the opposite side.

The present invention ensures this proper sealing, even in imperfect situations by means of a novel pad backing assembly. The assembly may be oriented parallel to a plane of a tone hole by connection to a pad cup using a hot melt glue, liquid resin, or the like. This connection material allows the assembly, and thus the pad, some flexibility in orientation with respect to the pad cup. In other words, using this liquid resin, hot melt glue, or the like, allows the assembly to be not aligned with the cup, but instead with the tone hole. In one embodiment, this alignment of the pad backing assembly can be achieved by compressing the assembly against a rigid "dummy" pad, which is held in contact with the tone hole-thereby aligning the assembly with the tone hole.

Further, the pad backing assembly may comprise a walled chimney extending upward towards a washer which holds the assembly and pad to the cup. This chimney may hold the pad against the washer providing a spacing between the washer and a spud extending upward from a cup base which is used to screw the washer to the cup of the pad holder. In an embodiment such as described in case 1 noted above with respect to the related art, this spacing prevents the washer from clamping on the potentially misaligned spud, which would in turn pull the pad off alignment as well (refer to the figures for more detail). In an embodiment such as described in case 2 noted above with respect to the related art, the chimney may support the pad against its respective flanged bushing with less pressure than is required by the prior art. This lower pressure reduces the chance for deformation of the pad.

It is to be understood that the pad assembly has a top view with a circular or approximately circular cross section, such that when viewed from above, the pad assembly appears roughly circular with a central opening. While all views are shown as cross sectional views, it is to be understood that the assembly is approximately circular having a central opening through which a screw may pass when assembled.

Turning now to FIG. 1, an embodiment of the present invention utilizing the pad assembly is provided. A key cup 1 is shown which receives the pad and pad assembly. A spud receiver 7 is soldered into place on the key cup 1. A quantity of hot melt glue 2 (or equivalent adhesive) joins assembly base 31 to key cup 1. Pad 4 is connected to pad base 31. Washer 5 fits over the pad 4 and is attached pad 4 and the rest of the assembly to the key cup 1 by pad screw 6 connecting to spud receiver 7. Pad base 31 can be seen having a chimney 32 which protrudes upwards from an inner circumference of the base 31 adjacent to a circular central opening. As a reminder, the pad base 31 is approximately circular in shape, and thus chimney 32 is also approximately circular and extends about an interior opening in the pad base 31.

Pad 4 can be seen having multiple components. A foam or felt/suede pad 41 may have a sealing membrane applied to its top. Beneath the pad is a spacer 42 which may be a piece of paper, board, plastic, or the like. A thicker supporting spacer 43 provide additional spacing and support to position the pad 41. A pad retainer 44 supports a bottom and optionally an outer perimeter of the pad 4, in this embodiment. It should be understood that the pad retainer 44 is formed integrally with the pad piece itself. The pad retainer is a lower layer of the pad structure that retains and supports the pad 41. In typical embodiments, the pad retainer 44 will not be visible from the outside of the pad 4, unless the pad is cut in a cross section as shown in the figures.

Figure 2:
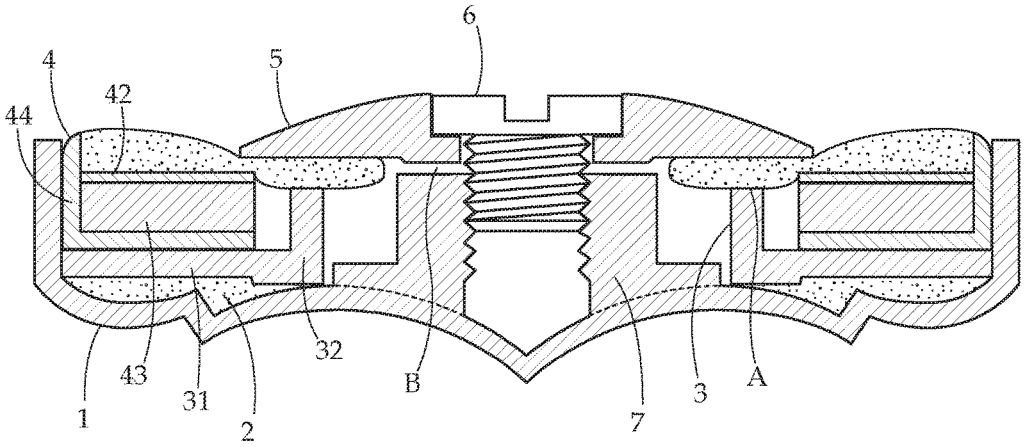
FIG. 2 provides a side cross sectional view of another embodiment of the present invention.

FIG. 2 provides a view of the present invention in an assembled position. Adhesive 2 can be seen filling in spacing between key cup 1 and pad base 31. Pad 4 is held in place to pad base 31 by washer 5 being held in place by screw 6 connected to spud 7. It is important to note that in this embodiment, washer 5 is separated from a top face of the spud 7 by spacing B. Further, the chimney 32 of the pad base 31 extends upward and urges pad 4 (specifically element 41) against the washer 5 at area A. Thus, as assembled, the present invention compresses the pad 41 between the chimney 32 and washer 5.

Figure 3:
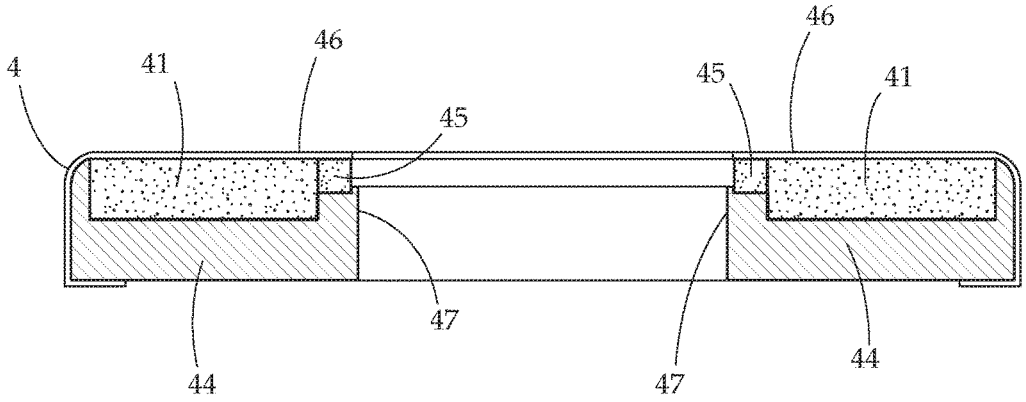
FIG. 3 provides a side cross sectional view of yet another embodiment of the present invention.

FIG. 3 provides another embodiment of the present invention pad assembly. In this view, chimney 47 is an integral part of pad retainer 44, and protrudes upward from the pad retainer 44 at an inner circumference, adjacent to a central opening. Here, the chimney extends from the pad retainer 44, as opposed to pad base 31 as in the embodiment of FIGS. 1 and 2. In this view, a ring insert 45 is positioned above chimney 47. In this embodiment, ring insert 45 is formed of a material that is harder than pad 41 in order to achieve the desired clamping effect between chimney 47 and a washer (not shown, in other figures element 5). A top layer 46 extends over a top of both pad 41 and ring insert 45, though this is not necessarily the case in all embodiments. This top layer may be, for example a thin membrane such as gold beater skin or fish skin, which are used in the art. The ring insert 45 may be configured in a number of different ways. For example, in one embodiment, the ring insert may be integrated into the pad itself. In such an embodiment, the pad and ring insert may be integral, such that the pad may simply have a portion adjacent to the interior opening that is formed of a material that is harder than the remainder of the pad. This qualifies as ring insert 45.

Figure 4:
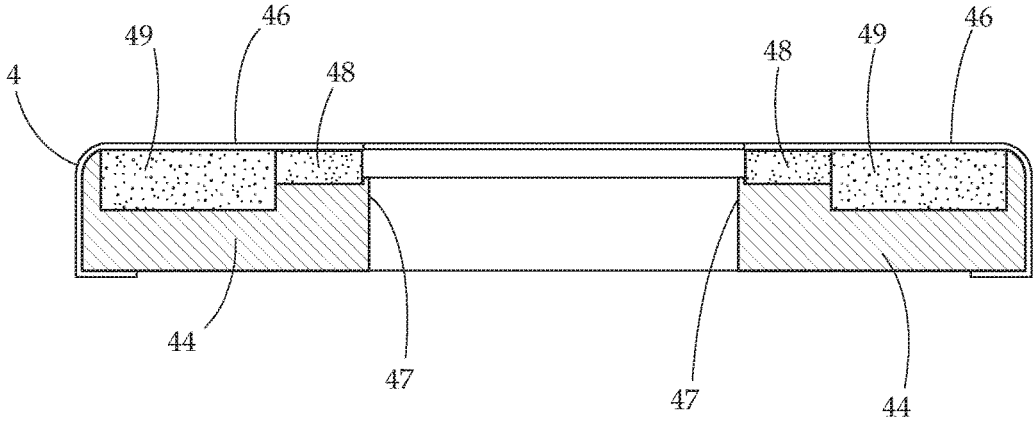
FIG. 4 provides a side cross sectional view of still another embodiment of the present invention.

FIG. 4 provides yet another embodiment of the present invention. In this view, chimney 47 is an integral part of pad retainer 44, and protrudes upward from an inner circumference the pad retainer 44 adjacent to a central opening. Here, the chimney extends from pat retainer 44, as opposed to pad base 31 as in the embodiment of FIGS. 1 and 2. Instead of a ring insert and pad being materials of different hardnesses as was used in the embodiment of FIG. 3, the embodiment shown in FIG. 4 utilizes ring insert and pad as materials of differing thicknesses. In this view, ring insert 48 is formed of a same material as pad 49 with pad 49 being thicker than ring insert 48. A top layer 46 extends over a top of both pad 49 and ring insert 48. This top layer may be, for example a thin membrane such as gold beater skin or fish skin, which are used in the art. The ring insert 48 may be configured in a number of different ways. For example, in one embodiment, the ring insert 48 may be integrated into the pad itself. In such an embodiment, the pad and ring insert 48 may be integral, such that the pad may simply have a portion adjacent to the interior opening that is formed of a material that is thinner than the remainder of the pad. This qualifies as ring insert 48.

Figure 5:
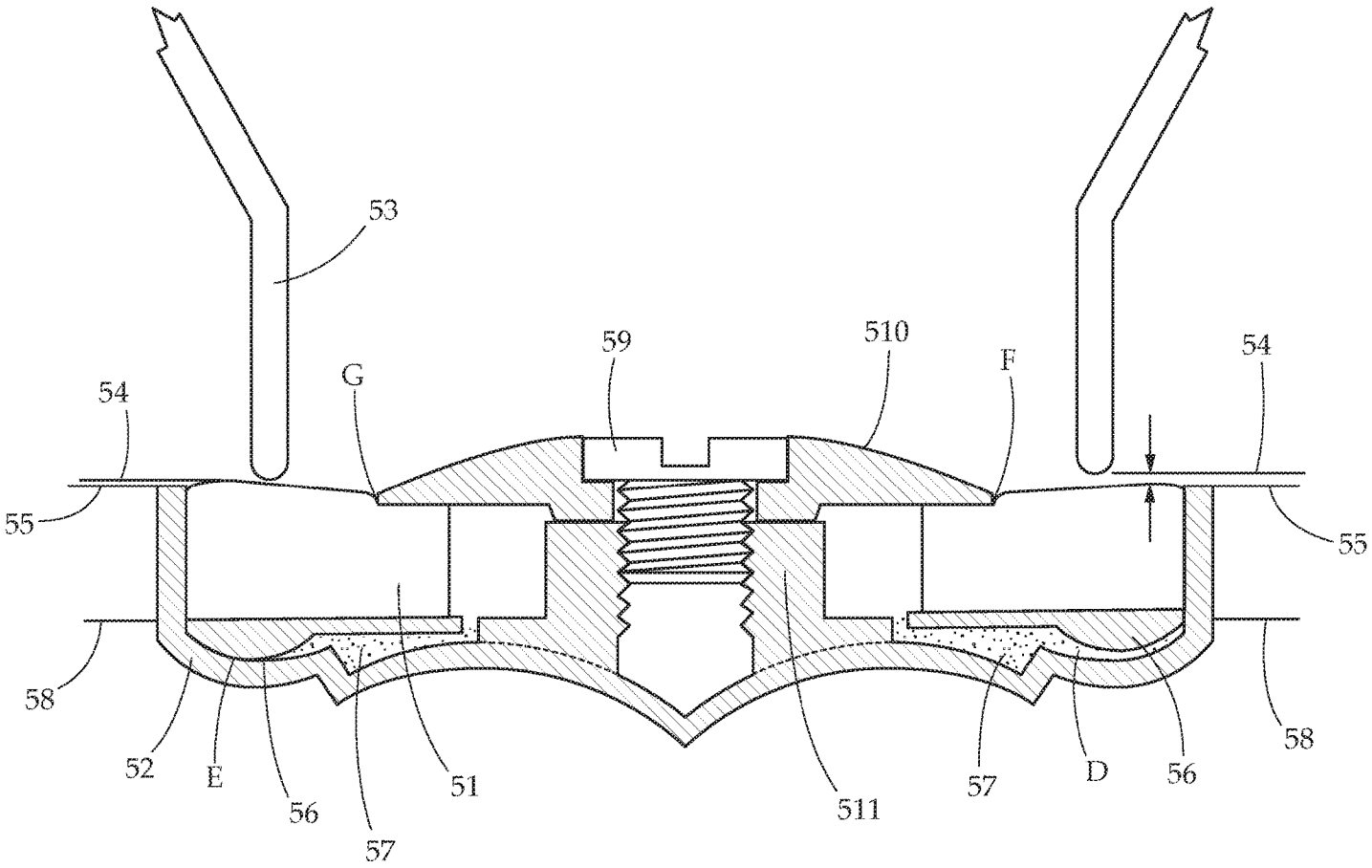
Fig. 5 Prior Art
FIG. 5 provides a side cross sectional view of a prior art pad assembly in operation.

FIG. 5 provides a view of a prior art embodiment of a pad assembly. In this prior art, pad assembly 51 is attached to cup 52 using adhesive 57. In this case, the cup 52 is not properly oriented to its respective tone hole 53. As such, a plane shown as line 54 is not coincident with the plane defined by cup 52, shown as line 55. The divergence of these lines 54, 55 highlights this misalignment, indicated by arrows. Therefore, as shown, the pad 51 when installed with respect to the orientation of cup 2, as is taught in the prior art, will contact one side of the tone hole 53 at point B before it contacts the tone hole 53 (if at all) at point C. This uneven contact results in, among other things, a gap through which air can leak and disrupt the instrument's sound. While instrument makers such as Flute makers seek to avoid such a situation, it does occur on occasion and can occur or be worsened through use or wear and tear of the instrument. Because the tone holes and pad assemblies are three dimensional having approximately circular top-down cross section (the embodiment of FIG. 5 being shown as a side cross sectional view), the occurrence of such a gap or misalignment is not limited to the front and rear of the cup. Indeed this gap or misalignment may occur at any point along the pad to tone hole interface's circumference.

Typical prior art solutions include "floating" the pad backing 56 on a layer of adhesive 57 to adjust the pad 51 to a proper orientation, shown by line 58 which is parallel to line 54. This attempt can be seen in FIG. 5, as the gap between pad backing 56 and cup 52 is greater at point D on the right side of the figure than point E on the left side. However, the prior art still suffers from the shortcoming that when screw 59 is tightened to spud 511, pad washer 510 will contact to the top of spud 511. This is because of spud's 511 rigid connection to cup 52, and is a design feature of the prior art. Because of this contact, pad 51 will be compressed more at point F than at point G, which will cause the flexible pad 51 to conform back to the improper alignment of cup 52 resulting again in a gap at point C. This uneven compression also deforms pad 51, increasing the likelihood of further gaps and improper operation.

Further regarding the prior art view shown in FIG. 5, it can be seen that pad backing 56 has a ring shape, with a downward protrusion on its outer portion of the ring about an outer circumference. Such a downward protrusion aids in fitting the pad backing 56 to cup 52. By contrast, as shown in the remainder of the figures, the present invention utilizes a base 31 having a flat or nearly flat bottom face. Thus, the present invention omits the bottom protrusion of the prior art. This structural difference provides a number of advantages not found in the prior art, including more flexibility in "floating" of the base 31 with respect to the cup 1, 52.

Figure 6:
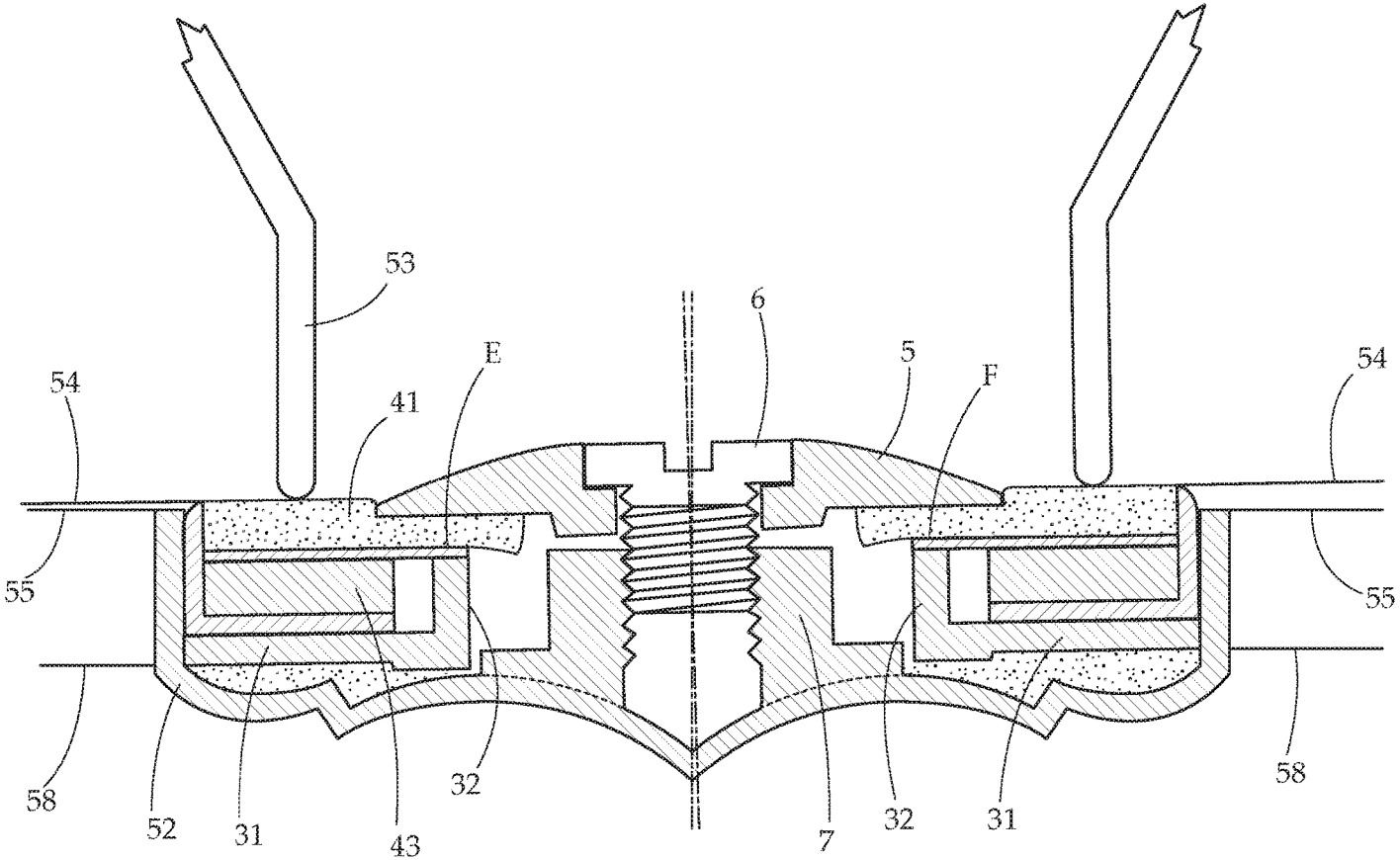
FIG. 6 provides a side cross sectional view of an embodiment of the present pad assembly in operation.

FIG. 6 provides a view of the present invention solving the issue of a misaligned tone hole and cup, and showing how the present invention nevertheless provides an optimal seal of the tone hole. Pad assembly comprises the pad base 31, chimney 32, pad 41, and supporting spacer 43. This assembly is installed in the cup 52. The planar orientation of cup 52, shown by line 55 is no coincident with that of the tone hole 53, shown by line 54. The pad base 31 of the present invention is attached to the cup 52 by the adhesive, and this adhesive is adjusted in thickness such that the orientation of pad base 31, shown as line 58, is parallel to the plane of the tone hole 54. In this embodiment, screw 6 is tightened only until pad 41 is sufficiently compressed between washer 5 and the chimney 32 of pad base 31. This compression can be seen at points E and F. In this embodiment, washer 5 does not contact spud 7. Accordingly, there is no opportunity of the pad to conform to the improper orientation of cup 2, and the pad assembly is retained in its optimal alignment all around its circumference. Thus, it can be seen that the present invention utilizes an upwardly protruding chimney on either a pad-supporting base (31 and 32), or on the pad retainer 44 at an inner portion of the ring to allow a pad to fully seal around the entirety of a tone hole when in a closed position even in the event that the cup and tone hole are out of alignment due to bending or warpage and/or improperly installed spuds.

While several variations of the present invention have been illustrated by way of example in preferred or particular embodiments, it is apparent that further embodiments could be developed within the spirit and scope of the present invention, or the inventive concept thereof. However, it is to be expressly understood that such modifications and adaptations are within the spirit and scope of the present invention, and are inclusive, but not limited to the following appended claims as set forth.

What is claimed is:

1. A pad assembly for a woodwind instrument comprising:

a base configured to be attached to a cup of an instrument key assembly;

a pad retainer positioned on a top of the base;

a pad positioned above the pad retainer, the pad retainer extending under a majority of the pad;

wherein the base, pad retainer, and pad all have an approximately circular top-view cross section, each having an approximately circular central opening; and a chimney formed by the base, the chimney being an upward protrusion extending towards the pad and extending about an inner circumference of the base adjacent to the circular central opening.

2. The pad assembly for a woodwind instrument of claim 1 wherein the assembly is attached to the cup of the instrument key, a washer holding the pad assembly to the cup by a screw connected to a spud attached to the cup, the screw passing through the approximately circular opening of each of the pad, the pad holder, and the base.

3. The pad assembly for a woodwind instrument of claim 2 wherein the washer is spaced apart from a top surface of the spud and does not contact the top surface of the spud.

4. The pad assembly for a woodwind instrument of claim 2 further comprising a quantity of adhesive connecting the base to the cup.

5. The pad assembly for a woodwind instrument of claim 2 wherein a plane defined along a top of the cup is not coincident with a plane defined along a top of a tone hole when the cup is in a closed position and wherein the pad seals about a circumference of the tone hole when in the closed position.

6. The pad assembly for a woodwind instrument of claim 1 wherein the instrument is a flute, and wherein the pad assembly is sized and configured to seal at least one tone hole of the flute.

7. The pad assembly for a woodwind instrument of claim 1 wherein the pad further comprises a thin membrane layer over a top surface.

8. A pad assembly for a woodwind instrument comprising:

a base configured to be attached to a cup of an instrument key assembly;

a pad retainer positioned on a top of the base;

a pad positioned above the pad retainer, the pad retainer extending under a majority of the pad;

wherein the base, pad retainer, and pad all have an approximately circular top-view cross section, each having an approximately circular central opening;

a chimney formed by the pad retainer, the chimney being an upward protrusion extending towards the pad and extending about an inner circumference of the pad retainer adjacent to the circular central opening; and a ring insert having a ring shape, the ring insert positioned on a top of the chimney, the ring insert having a thickness different from a thickness of the pad and providing an approximately continuous face across a top of the pad and a top of the ring insert.

9. The pad assembly for a woodwind instrument of claim 8 wherein the assembly is attached to the cup of the instrument key assembly, a washer holding of the pad assembly to the cup by a screw connected to a spud attached to the cup, the screw passing through the approximately circular opening of each of the pad, the pad holder, and the base.

10. The pad assembly for a woodwind instrument of claim 9 wherein the washer is spaced apart from a top surface of the spud and does not contact the top surface of the spud.

11. The pad assembly for a woodwind instrument of claim 9 further comprising a quantity of adhesive connecting the base to the cup.

12. The pad assembly for a woodwind instrument of claim 9 wherein a plane defined along a top of the cup is not coincident with a plane defined along a top of a tone hole when the cup is in a closed position, and wherein the pad seals about a circumference of the tone hole when in the closed position.

13. The pad assembly for a woodwind instrument of claim 8 wherein the instrument is a flute, and wherein the pad assembly is sized and configured to seal at least one tone hole of the flute.

14. The pad assembly for a woodwind instrument of claim 8 wherein the pad further comprises a thin membrane layer over a top surface.

15. A pad assembly for a woodwind instrument comprising:

a base configured to be attached to a cup of an instrument key assembly;

a pad retainer positioned on a top of the base;

a pad positioned above the pad retainer, the pad retainer extending under a majority of the pad;

wherein the base, pad retainer, and pad all have an approximately circular top-view cross section, each having an approximately circular central opening;

a chimney formed by the pad retainer, the chimney being an upward protrusion extending towards the pad and extending about an inner circumference of the pad retainer adjacent to the circular central opening; and a ring insert having a ring shape, the ring insert positioned on a top of the chimney, the ring insert having a hardness different from a hardness of the pad and providing an approximately continuous face across a top of the pad and a top of the ring insert.

16. The pad assembly for a woodwind instrument of claim 15 wherein the assembly is attached to the cup of the instrument key assembly, a washer holding the pad assembly to the cup by a screw connected to a spud attached to the cup, the screw passing through the approximately circular opening of each of the pad, the pad holder, and the base.

17. The pad assembly for a woodwind instrument of claim 16 wherein the washer is spaced apart from a top surface of the spud and does not contact the top surface of the spud.

18. The pad assembly for a woodwind instrument of claim 16 further comprising a quantity of adhesive connecting the base to the cup.

19. The pad assembly for a woodwind instrument of claim 16 wherein a plane defined along a top of the cup is not coincident with a plane defined along a top of a tone hole when the cup is in a closed position, and wherein the pad seals about a circumference of the tone hole when in the closed position.

20. The pad assembly for a woodwind instrument of claim 15 wherein the instrument is a flute, and wherein the pad assembly is sized and configured to seal at least one tone hole of the flute.

* * * * *